US005802987A

United States Patent [19]

Bellak et al.

[11] Patent Number: 5,802,987

[45] Date of Patent: Sep. 8, 1998

[54] CANTILEVERED DISPLAY DEVICE

[76] Inventors: David K. Bellak; Jonathon G. Bellak, both of P.O. Box 16735, Alexandria, Va. 22302-0735

[21] Appl. No.: 694,177

[22] Filed: Aug. 8, 1996

[51] Int. Cl.[6] ..... A47B 9/00

[52] U.S. Cl. ..... 108/108; 108/152

[58] Field of Search ..... 108/108, 109, 108/152, 106; 211/193, 187, 186

[56] References Cited

U.S. PATENT DOCUMENTS

| | | | |
|---|---|---|---|
| 845,917 | 3/1907 | Worley et al. | 108/108 X |
| 1,282,369 | 10/1918 | Belcher | 108/108 |
| 1,889,155 | 11/1932 | Sellentin | 108/96 |
| 2,615,583 | 10/1952 | Johnson | 108/152 |
| 2,649,972 | 8/1953 | Weil | 108/108 X |
| 4,109,961 | 8/1978 | Opsvik | 108/96 X |
| 5,088,420 | 2/1992 | Russell | 108/96 X |
| 5,365,860 | 11/1994 | Billington, III | 108/108 |

FOREIGN PATENT DOCUMENTS

| | | | |
|---|---|---|---|
| 150507 | 6/1955 | Sweden | 108/96 |

*Primary Examiner*—Jose V. Chen
*Attorney, Agent, or Firm*—Smith Patent Office

[57] ABSTRACT

A display unit is disclosed having at least one angled support member which is disposed at an angle of less than 90 degrees to the ground, at least one horizontally extending shelf bearing member operatively connected to the support member; and a shelf disposed on the shelf bearing member for supporting articles to be displayed. The display unit can have adjustable shelves and may also contain a central shaft member that is used to hold the shelf supports. The display unit can serve many varied functions separately or in various combinations. Such functions can include a display shelf for art or articles for sale or in exhibition, a bookshelf, a planter box or holder, a music entertainment rack, a timepiece, a lighting fixture, a water fountain and a wind chime.

16 Claims, 11 Drawing Sheets

CANTILEVERED DISPLAY DEVICE

BACKGROUND OF THE INVENTION

1. Field of the Invention

The present invention relates to a display device or rack for supporting articles. More specifically, the display device includes a cantilevered shelf member that is attached to an angled support and allows articles such as books, lights, clocks, etc. to be supported in a functional and artistic fashion.

2. Discussion of the Related Art

Many different types of shelves for supporting articles are presently known. Some of these shelves include a shelf that is interlocking with a fixed upright base. It is also known to provide a cantilevered shelf that has a wall mounted fixed base or a base that uses its own casework foundation.

U.S. Pat. No. 3,826,207 discloses collapsible adjustable shelving with upright vertical support members that allow support brackets to be inserted therein. These support brackets then support horizontal shelves for receiving articles.

Similar types of shelving are disclosed in U.S. Pat. Nos. 5,253,835; 5,364,052; 5,365,860 and all show a vertical support member which allows for adjustable positioning of a horizontal shelf member. U.S. Pat. No. 5,381,738 discloses an adjustable and collapsible work table assembly that comprises a vertical support member and horizontally extending brackets for supporting a horizontal shelf.

U.S. Pat. No. 5,154,388 discloses a support bracket that can be configured such that it can extend either orthogonally to the vertical support or at an angle to the vertical support depending on the particular requirements of the user and the type of display desired.

U.S. Pat. No. 4,716,841 relates to a merchandising display shelving unit that includes an adjustable vertical telescoping shelf support which allows identical shelves to be positioned at any desired height on the support. The telescoping shelf support structure includes a lower support member that is provided at a slight angle to the vertical to allow for adjustably positioning the lower horizontally extending shelves.

None of these references disclose an upright support that is at an angle of less than 90 degrees to horizontal surface level and which supports a horizontally extending shelf for supporting articles. Nor do they depend on cantilever action for achieving stability. The closest structure that the inventor is aware of relates to a bottle support shown in U.S. Pat. No. 4,496,124. In this patent, an angled bottle support is shown which extends at an angle of 60 degrees from the table. The neck of the bottle is inserted into the bottle support and holds it in a slightly inclined position. However, this is not a horizontally extending shelf which is capable of supporting articles.

SUMMARY OF THE INVENTION

The display unit of the present invention has been designed to serve many varied functions separately or in various combinations. These functions can include a display shelf for art or articles for sale or in exhibition, a bookshelf, a planter box or holder, a music entertainment rack, a timepiece, a lighting fixture, a water fountain and a wind chime.

An object of the present invention relates to providing a display unit that can have multiple purposes and uses.

A further object of the present invention is to provide a display unit that has a unique appearance.

A still further object of the present invention is to provide a display unit that can be simply and economically produced.

Another object of the present invention is to provide a display unit that is capable of standing upright when it appears that it should fall over.

Another object of the present invention is to provide a display unit that uses cantilevered action for support.

A display unit according to the present invention can include at least one angled support member that is disposed at an angle of less than 90 degrees to a horizontal surface (such as the ground), at least one horizontally extending shelf bearing member operatively connected to the support member, and a shelf disposed on said shelf bearing member for supporting articles to be displayed.

A display unit according to the present invention can also include first and second angled support members which are disposed at an angle of less than 90 degrees to the ground, a spacer member connected to the first and the second angled support members, a central shelf member disposed between and extending from the first and second angled support members in a cantilevered manner, first and second horizontally extending shelf members disposed on opposite sides of and connected to the central shelf member, and wherein a top surface of the first and second horizontally extending shelf members and a top surface of the central shelf member form a shelf for receiving articles thereon.

BRIEF DESCRIPTION OF THE DRAWINGS

The above and other objects and features of the present invention will be clearly understood from the following description with respect to the preferred embodiments thereof when considered in conjunction with the accompanying drawings, in which.

DETAILED DESCRIPTION OF THE PREFERRED EMBODIMENTS

Figure 1:
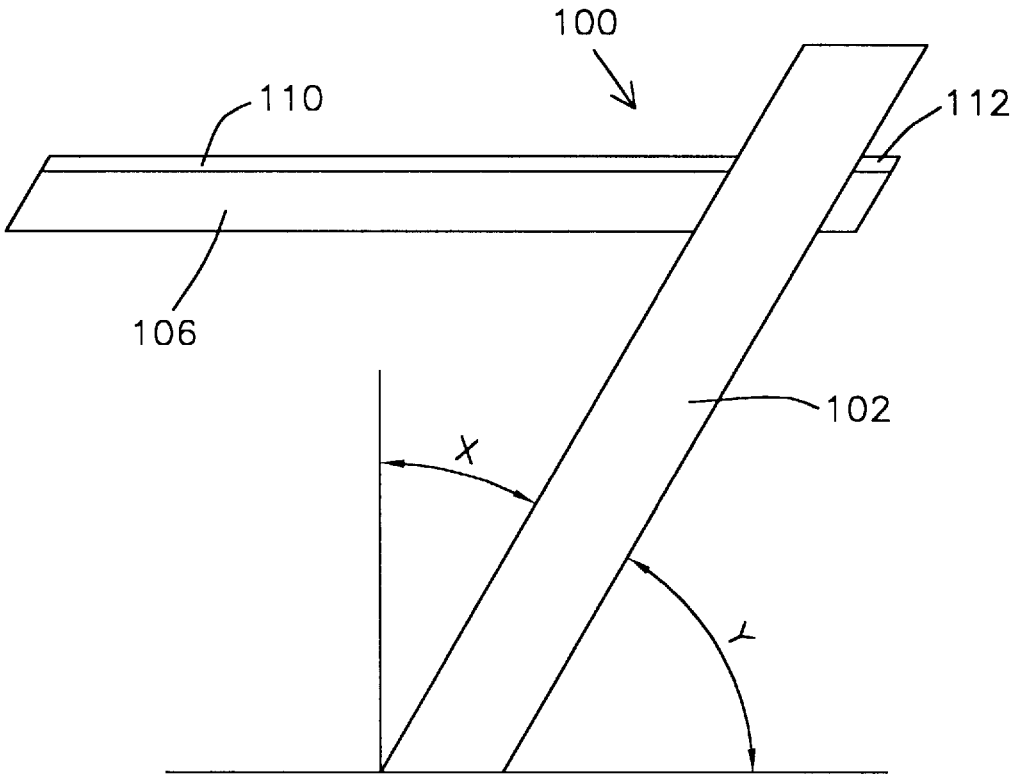
FIG. 1 is a side view of the general overall shape of the display unit according to a preferred embodiment of the present invention.
Figure 2:
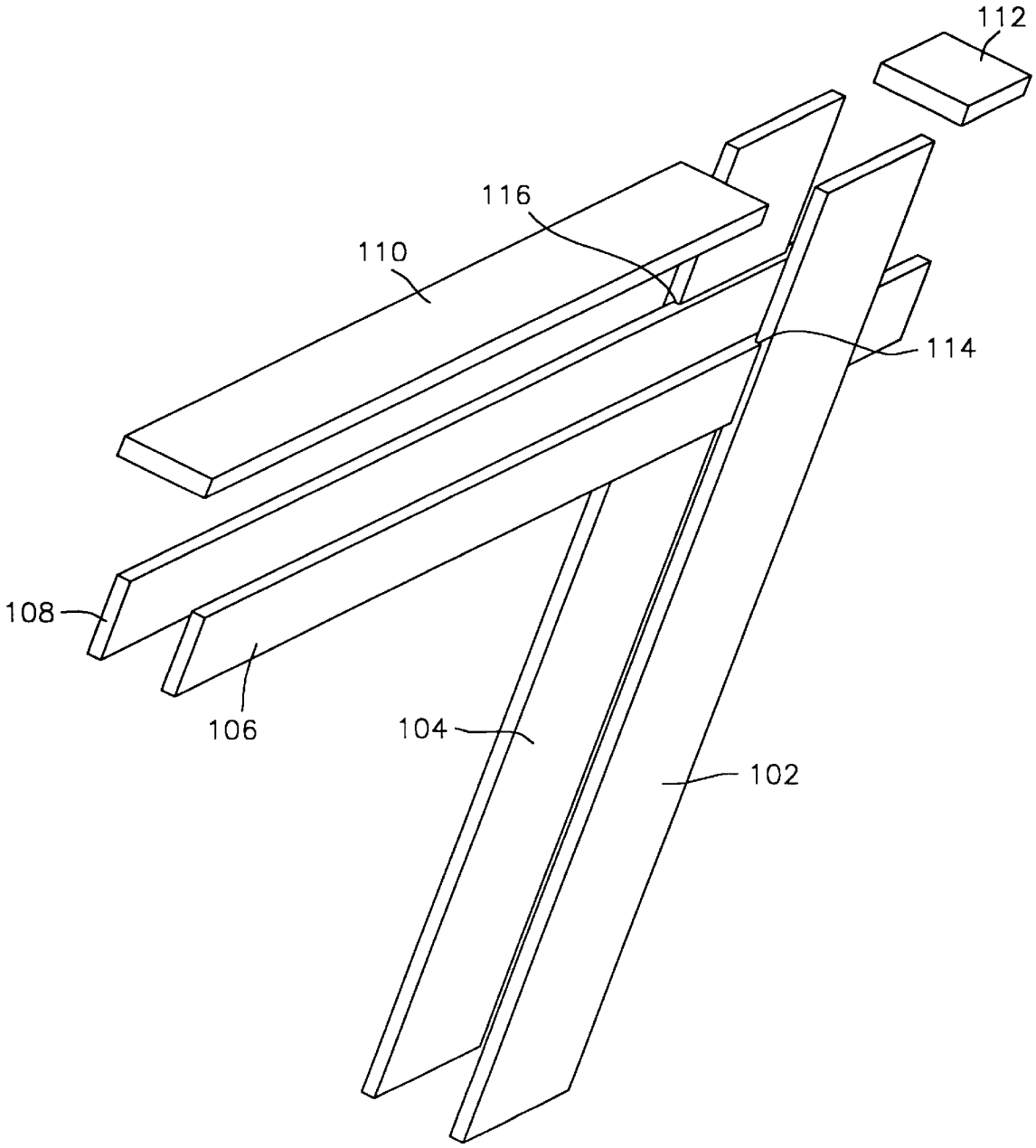
FIG. 2 is an exploded perspective view of the display unit shown in FIG. 1.

FIGS. 1 and 2 show a display unit 100 having a pair of angled support members 102 and 104 and a pair of shelf bearing members 106 and 108. Located on top of the shelf bearing members 106 and 108 is a horizontally extending shelf and 110 and a rearward horizontally extending shelf 112. These shelves 110 and 112 are designed to support many different types of objects including books, art objects, etc.

The angled support members 102 and 104 include respective grooves 114 and 116 that can receive a portion of the shelf bearing members 106 and 108 in an interlocking fashion. These can be attached by friction, adhesive or other methods known in the art.

In FIG. 1, the angled support members 102 and 104 are positioned at an angle of approximately 60 degrees from the horizontal. This is a preferred angle although this angle can be varied in a range from 40–80 degrees and still achieve the support features of the display device.

Figure 3:
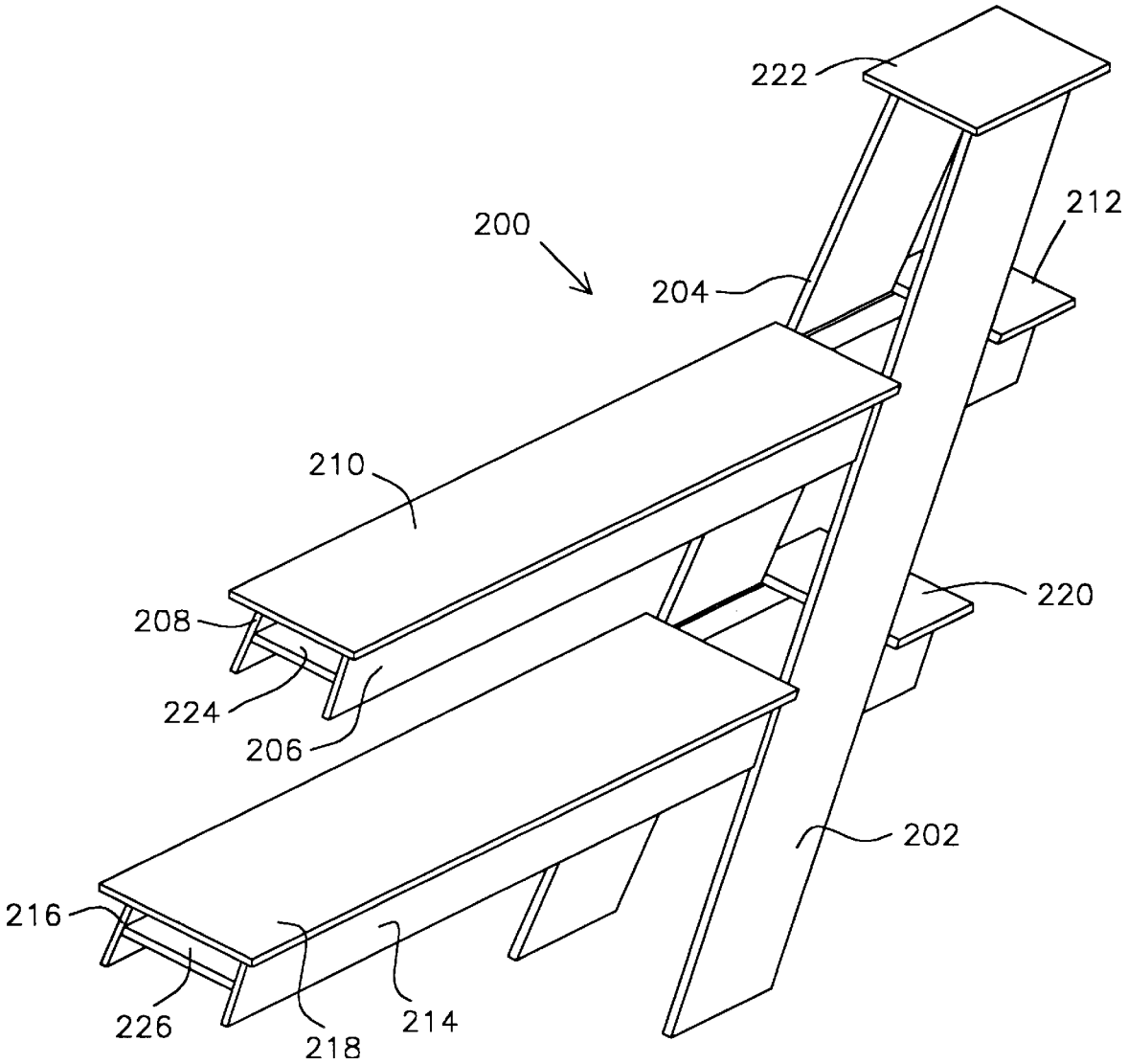
FIG. 3 is a perspective view of another embodiment of the display unit including two shelves with tapered angled support members.
Figure 4:
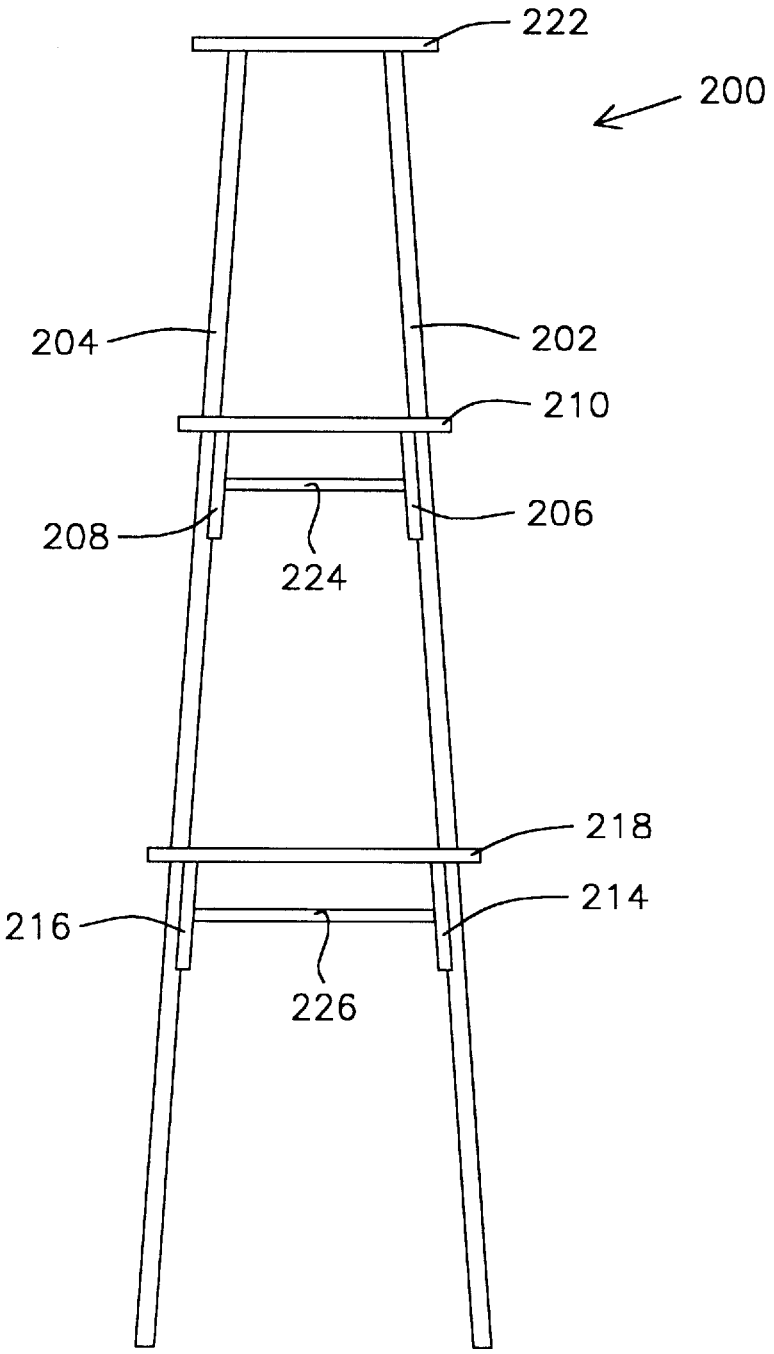
FIG. 4 is a front view of the display unit shown in FIG. 3.
Figure 5:
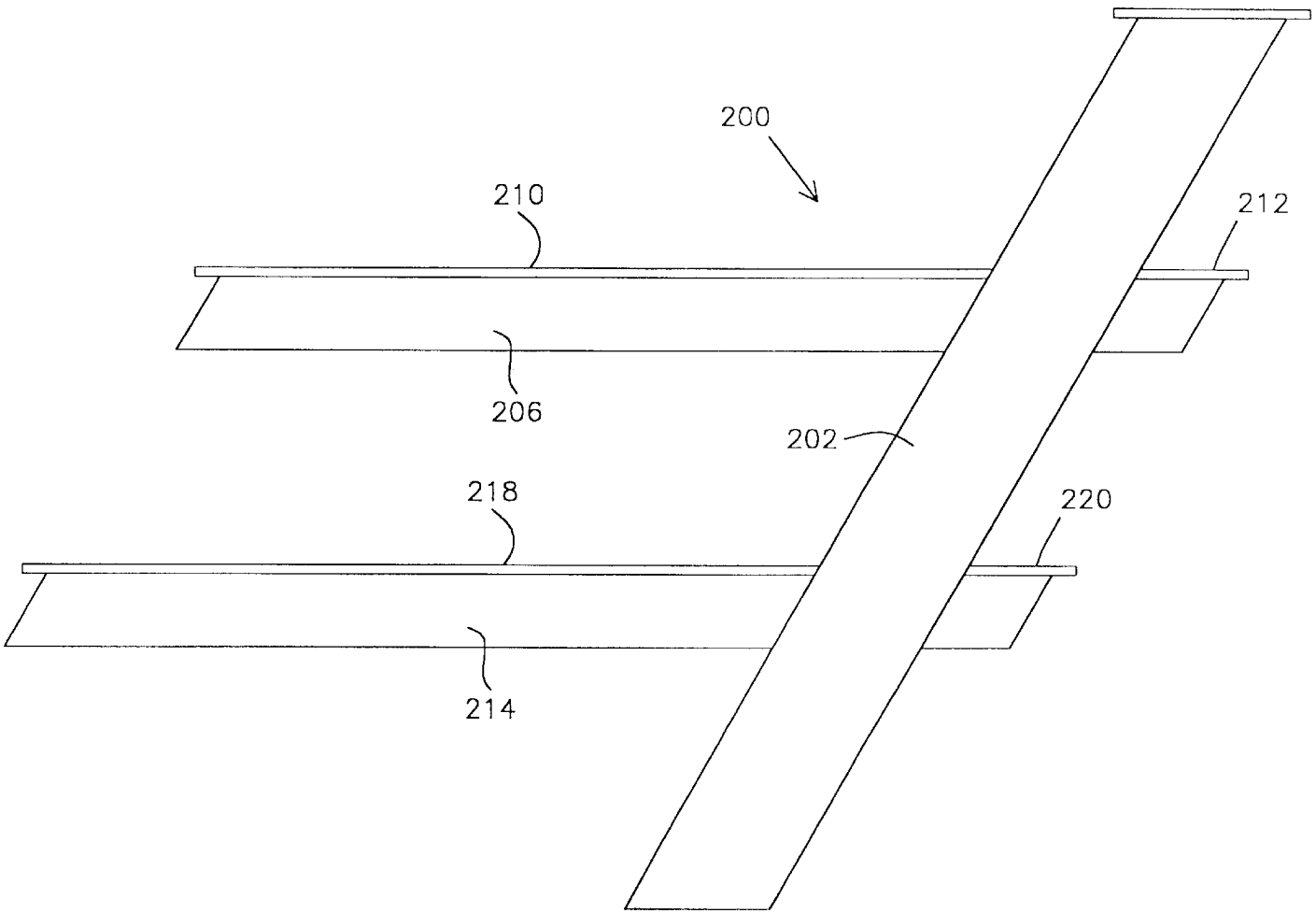
FIG. 5 is a side view of the display unit shown in FIG. 3.

FIGS. 3–5 disclose another type of display unit 200. The display unit 200 includes a first inwardly inclined angled support member 202 and a second inwardly inclined angled support member 204. By inwardly inclining the support members additional stability of the display unit 200 can be achieved.

The display unit 200 also includes more than one shelf for supporting articles. Specifically, a pair of first shelf bearing members 206 and 208 are provided for supporting a first horizontally extending shelf 210 and a first rearward horizontally extending shelf 212. Also, a pair of second shelf bearing members 214 and 216 are provided for supporting a second horizontally extending shelf 218 and a second rearward horizontally extending shelf 220.

A horizontally extending top 222 is provided on the top of the inclined angled support members 202 and 204. The top 222 is positioned on the support members 202 and 204 so as to overhang them and provide the same appearance as the shelves 218 and 220.

It is also possible to provide an additional member to the shelf that can perform several functions. These functions include bracing the shelf, allowing weights to be positioned thereon for weighted balancing and hiding cords from electrical equipment such as lights and stereo equipment placed on the shelf. This additional member is a first brace member 224 between the first shelf bearing members 206 and 208. As seen in FIG. 3, a second brace member 226 is also provided between the second shelf bearing members 216 and 218. On either of these shelves, weights can be placed to provide additional ballast. These weights can be moved along the length of the brace members 224 and 226 to selectively place the weights along the brace members for balancing the shelf if needed.

Figure 6:
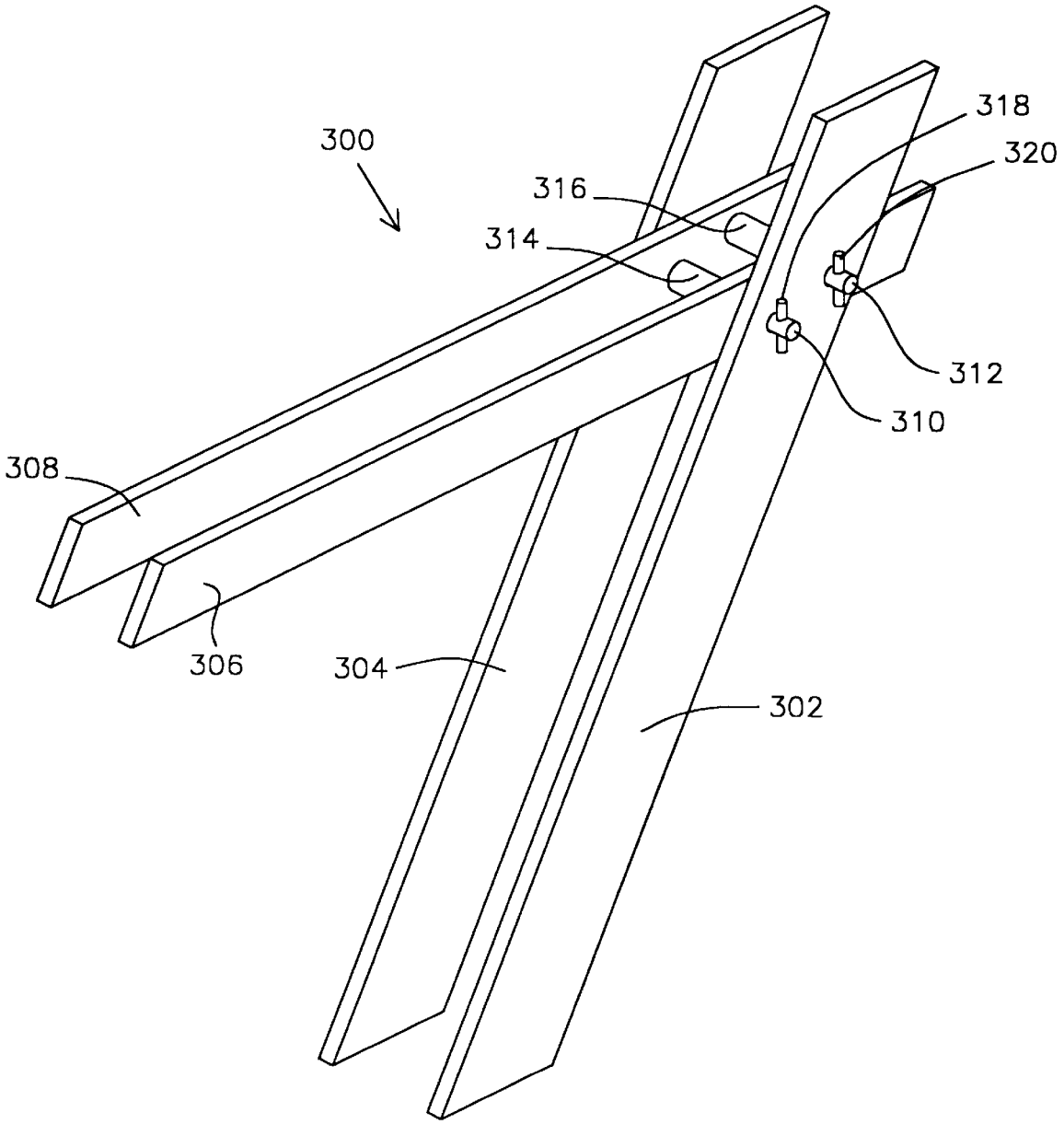
FIG. 6 is a perspective view of another embodiment of a potentially adjustable display unit using a dowel interlocking mechanism.

FIG. 6 discloses another type of display unit 300 with a different way attaching the shelf bearing members to the angled support members. Specifically, a pair of angled support members 302 and 304 are provided. Disposed on the inside of each angled support member 302 and 304 are a pair of shelf bearing members 306 and 308. A pair of dowels 310 and 312 pass through openings provided in the angled support members 302 and 304 as well as the shelf bearing members 306 and 308. Between the shelf bearing members 306 and 308, the dowels 310 and 312 pass through a pair of sleeves 314 and 316. These sleeves prevent the shelf bearing members from moving away from the angled support members 302 and 304. On both ends of the dowels 310 and 312, a pair of keys 318 and 320 are provided that lock the display unit 300 in place. Many different types of locking keys can be used for this purpose although a simple pass through key held by friction is shown.

Figure 7:
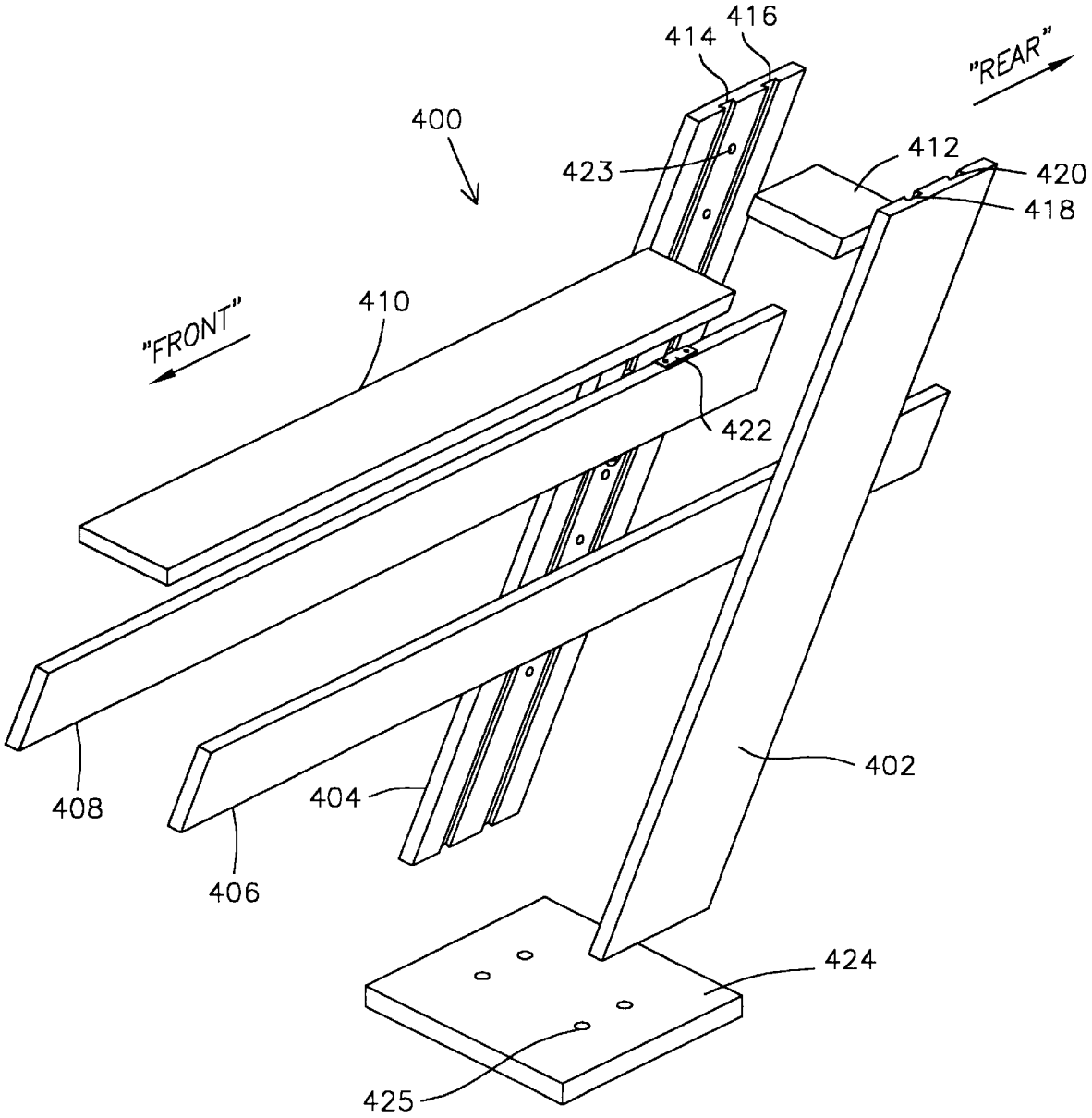
FIG. 7 is a perspective view of a still further embodiment of the display unit using a dual dovetail dado track for adjustment.

FIG. 7 illustrates another embodiment of a display unit 400. In this embodiment, a pair of angled support members 402 and 404 are used in conjunction with shelf bearing members 406 and 408. As in the other embodiments, a horizontally extending shelf 410 is provided on the shelf bearing members 406 and 408. A rearward shelf 412 is also provided on the rearward portion of the shelf bearing members 406 and 408.

On the inside surfaces of each of the angled support members 402 and 404, a pair of dovetail dados 414, 416, 418 and 420 are provided. Each of the shelf bearing members 406 and 408 are provided with a bracket such as bracket 422. The brackets can be positioned all along the length of the angled support members 402 and 404. However by attaching the bracket 422 in various holes 423 a more positive locked-in attachment point is achieved.

In any of the embodiments for this invention, it is possible to attach the angled support members, such as 402 and 404 to a base member 424 via holes 425. The base 424 provides added stability which may be desired in certain applications of the display device.

Figure 8:
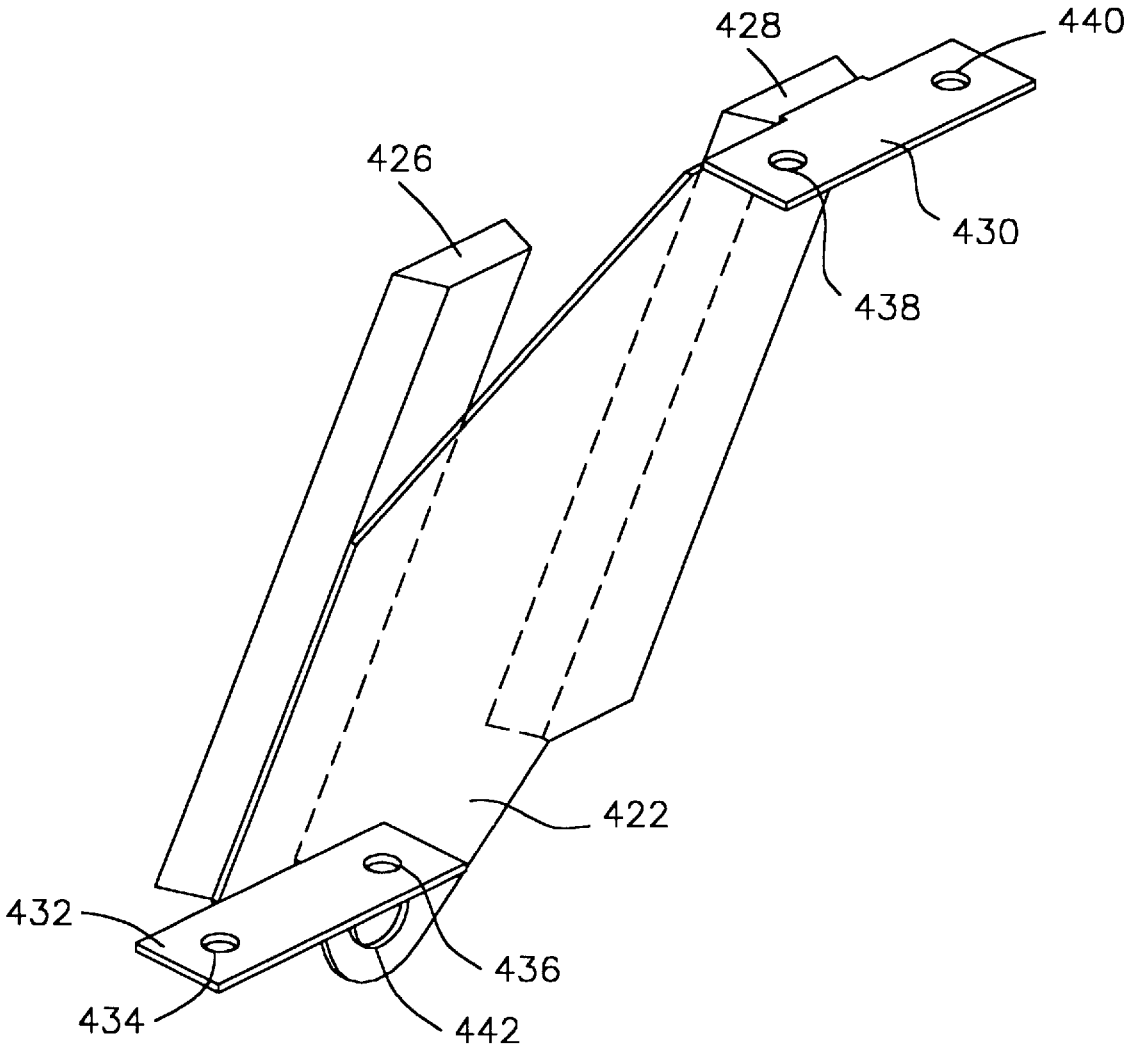
FIG. 8 is a detailed perspective view of the dovetail bracket use in the display unit shown in FIG. 7.

As seen clearly in FIG. 8, bracket 422 includes a pair of dovetail dado keys 426 and 428 that ride in the dovetail dados 414, 416, 418 and 420. The bracket 422 also includes an upper bracket flange 430 and a lower bracket flange 432 which position and support the shelf bearing members 406 and 408. The flanges 430 and 432 contain a pair of attachment holes 434, 436, 438 and 440 for allowing screws or similar items (not shown) to attach the shelf support members 406 and 408 to the brackets 422.

The bottom of the bracket 422 contains a further hole 442 which is provided to allow a set screw or similar item to be passed therein. The set screw is positionable in the holes 423 so as to allow for adjustable height positioning of the shelf 410.

Figure 10:
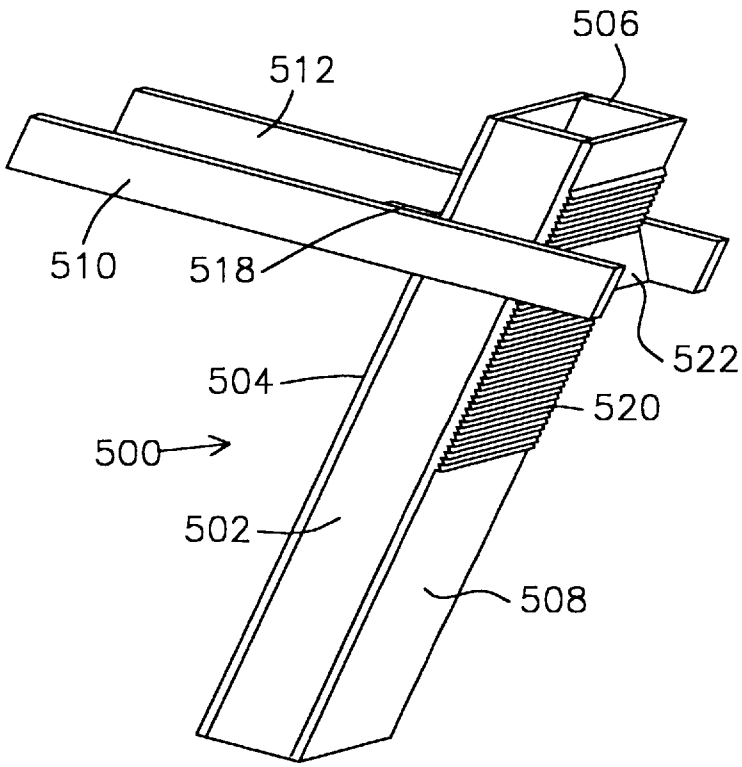
FIG. 10 is a rear perspective view of the display device shown in FIG. 9.
Figure 9:
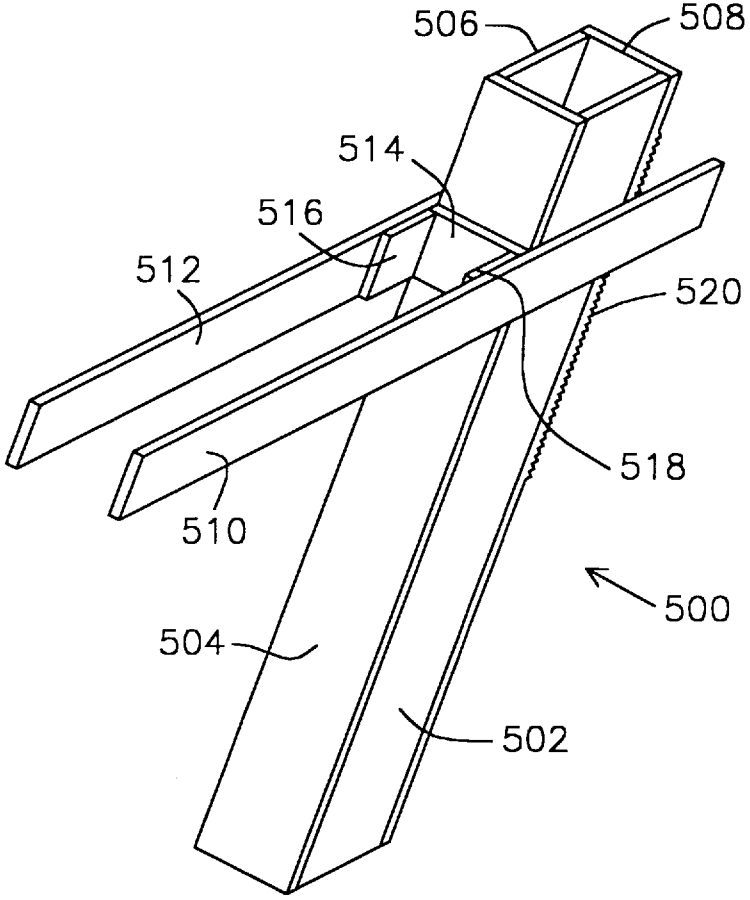
FIG. 9 is a perspective view of an adjustable display unit containing a central support according to another preferred embodiment of the invention.

FIGS. 9 and 10 disclose a further embodiment of a display unit 500 using a central support shaft instead of a pair of externally positioned angled support members. The central support shaft is comprised of the central shaft members 502, 504, 506 and 508 that are assembled to form a rectangular open ended box shape. A pair of shelf bearing members 510 and 512 are disposed on the outer surfaces of the central shaft members. Attached between the shelf bearing members 510 and 512 are a front engaging stop block 514 and two side braces 516 and 518 for the stop block. Together the stop block 514 and braces 516 and 518 form part of the means for positioning the shelf on the central shaft.

As seen clearly in FIG. 10, the back surface of the central shaft member 508 contains a rear engaging saw tooth pattern 520 for providing height adjustment for the shelf. The rearward side of the shelf bearing members 510 and 512 contain a rear engaging saw tooth stop 522 that is angled in such a way as to lock the shelf in place as shown in FIG. 10.

If no items are on the shelf, it is possible to tilt the shelf in a clockwise manner and unlock the saw tooth stop 522 from being engaged in the saw tooth pattern 520. Thus, the shelf is then free to adjust the height of the shelf from the floor and once the proper height is achieved, the shelf can be locked in place by rotating it counter clockwise until the front engaging stop block contacts the central shaft member 504 and the saw tooth stop 522 engages the saw tooth profile 520.

Although the unit is very stable, it is possible to overload one side with heavy items and cause a loss of stability. This situation can be solved by adding or repositioning additional weights on brace members, such as 224 and 226, so as to maintain stability.

Figure 11:
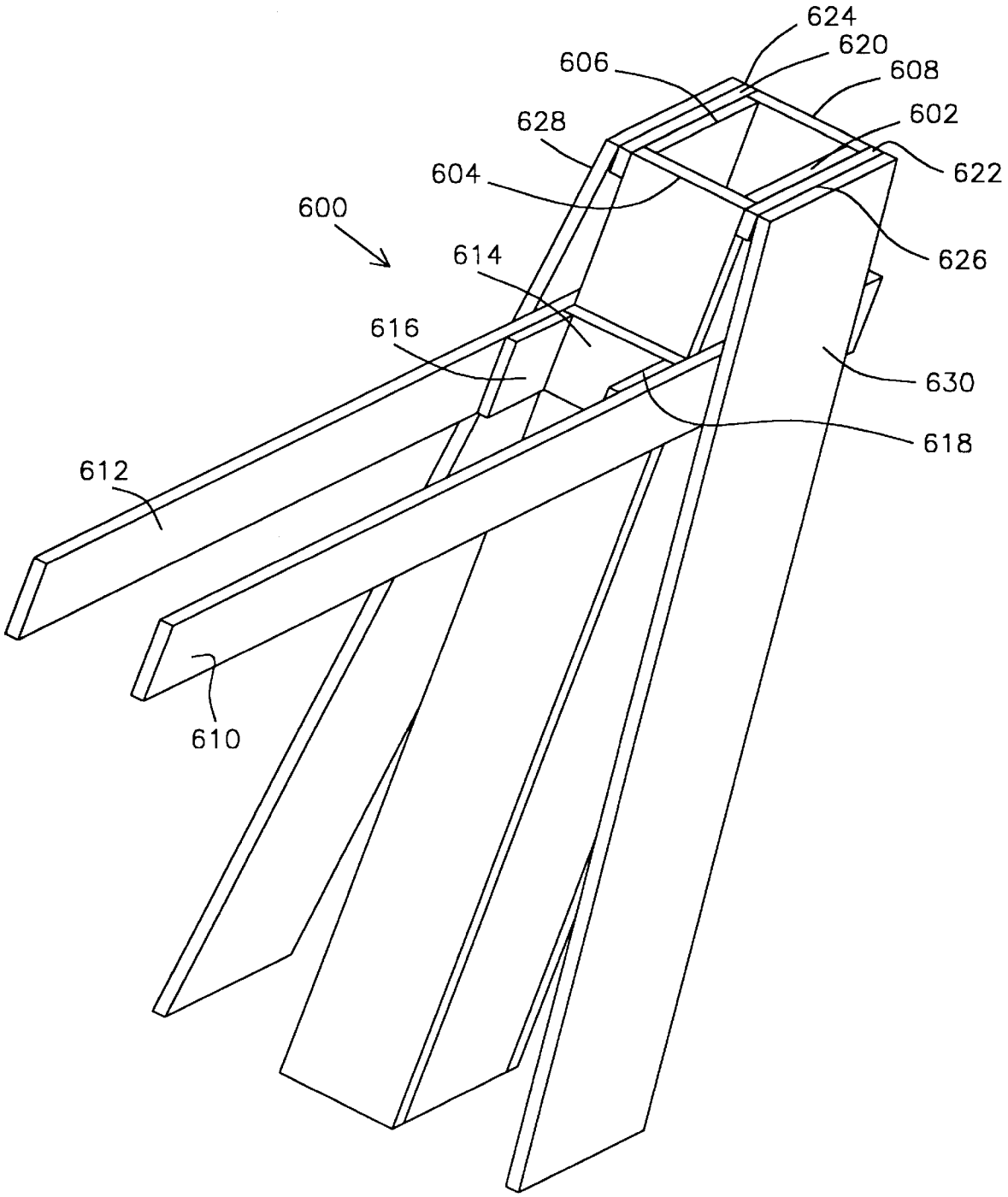
FIG. 11 is a perspective view of another embodiment of an adjustable display unit including hinged stabilizing upright members and a central shaft.

FIG. 11 discloses another embodiment of the display unit 600 that is similar to the display unit 500. Display unit 600 includes a central shaft made of the central shaft members 602, 604, 606 and 608. Attached to the central shaft are a pair of shelf bearing members 610 and 612 that are connected by front engaging stop block 614. Side braces 616 and 618 are also provided to brace the stop block 614 similar to FIGS. 9 and 10. Two extension members 620 and 622 are provided that extend from either side of the top of the central shaft. On the outer side of the extension members 620 and 622 are hinges 624 and 626 that are connected to a pair of stabilizing upright members 628 and 630, respectively. The stabilizing members 628 and 630 are movable between a position where they are adjacent to the central shaft and an extended, splayed position where they provide stability for the display device. The stabilizing members 628 and 630 also provide an aesthetic function by giving the display device an uninterrupted sight line from top to bottom. The stabilizing members act in a similar manner as the angled support members 202 and 204 of FIG. 3.

Figure 12:
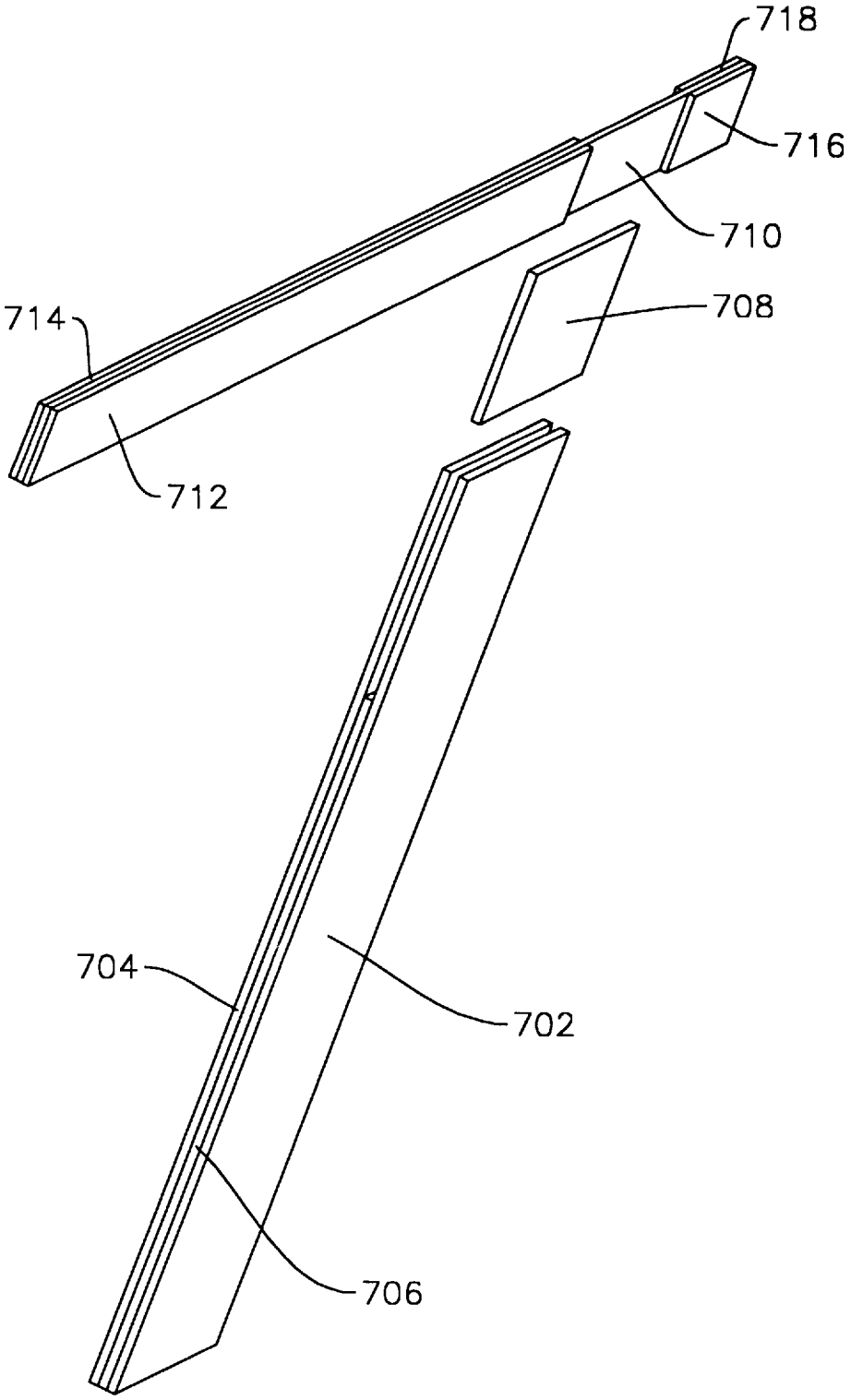
FIG. 12 is a perspective view of still a further embodiments of an adjustable display unit.

FIG. 12 discloses still a further embodiment of the display unit 700. The display unit 700 includes a pair of angled support members that are attached to a central spacer 706. The height of central spacer 706 is smaller than the angled support members 702 and 704. Located in the space formed between the angled support members 702 and 704 and the end of the central spacer 706 is either a spacer 708 or a portion of a horizontal shelf. As shown in FIG. 12, the spacer 708 is shown as the next structure that fits in this space between angled support members 702 and 704. The spacer 708 can have different heights to adjust the height positioning of the shelf. The shelf comprises a central horizontal board 710. To the board 710 is attached a pair of shelf support boards 712 and 714 as well as a pair of rear shelf support boards 716 and 718.

It is to be appreciated that the height and width of these boards can be changed to the specific width and/or height desired for the final assembly. It is also possible to have more than one shelf for this display unit by adding additional spacers between each shelf.

Other methods of adjustably positioning the horizontal shelves are possible and within the scope of this invention.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A display unit consisting of:

at least one angled support member which is disposed at an angle of less than 90 degrees to the ground;

at least one horizontally extending shelf bearing member operatively connected to said support member; and a shelf disposed on said shelf bearing member for supporting articles to be displayed, wherein said shelf bearing member and said shelf provide a cantilever action holding said display unit in an upright position.

2. A display unit as defined in claim 1, wherein said at least one angled support member is disposed at an angle between 40–80 degrees to the ground.

3. A display unit as defined in claim 1, wherein said shelf bearing member is adjustably positionable on said at least one angled support member.

4. A display unit as defined in claim 1, wherein said at least one angled support member comprises a central shaft member having a shelf engaging member disposed on an outer surface of said central shaft member for engagement with said shelf bearing member so that said shelf bearing member is disposed on the outer surface of said central shaft member.

5. A display unit as defined in claim 4, wherein said shelf engaging member includes a saw tooth pattern structure disposed on a rear surface of said central shaft member, said shelf bearing member being connected to a saw tooth back stop member that engages said saw tooth pattern structure so as to adjustably position said shelf bearing member.

6. A display unit as defined in claim 1, wherein said at least one angled support member comprises a pair of angled support members.

7. A display unit as defined in claim 6, wherein said pair of angled support members are inclined inwardly toward each other from a bottom portion to an upper portion.

8. A display unit comprising:

at least one angled support member which is disposed at an angle of less than 90 degrees to the ground, said support member comprising a pair of angled support members;

at least one horizontally extending shelf bearing member operatively connected to said support member; and a shelf disposed on said shelf bearing member for supporting articles to be displayed; and wherein said at least one horizontally extending shelf bearing members comprises a pair of horizontally extending shelf bearing members.

9. A display unit as defined in claim 8, wherein said pair of horizontally extending shelf bearing members is attached to said pair of angled support members.

10. A display unit as defined in claim 9, further comprising a dowel and a key arranged so that said dowel connects said shelf bearing members to said angled support members and said key is disposed in an end of said dowel to form the attachment.

11. A display unit as defined in claim 9, further comprising dovetail dados disposed in said angled support members and dovetail keys operatively connected to said shelf bearing members and sliding in said dovetail dados for providing adjustable positioning of said shelf bearing members.

12. A display unit as defined in claim 11, further comprising a bracket connected to at least one of said shelf bearing members, said bracket containing said dovetail keys disposed in said dovetail dados.

13. A display unit as defined in claim 9, further comprising a pair of stabilizing members connected in a hinged fashion to an upper portion of said angled support members for providing additional stability to said display unit.

14. A display unit as defined in claim 8, wherein said pair of angled support members is disposed at an angle between 40–80 degrees to the ground.

15. A display unit as defined in claim 8, further comprising a brace member attached between said pair of shelf bearing members and located below said shelf.

16. A display unit comprising:

first and second angled support members which are disposed at an angle of less than 90 degrees to the ground;

a spacer member connected to said first and said second angled support members;

a central shelf member disposed between and extending from said first and second angled support members in a cantilevered manner;

first and second horizontally extending shelf members disposed on opposite sides of and connected to said central shelf member, wherein a top surface of said first and second horizontally extending shelf members and a top surface of said central shelf member form a shelf for receiving articles thereon.

* * * * *